US006319160B1

(12) United States Patent
Hsu

(10) Patent No.: US 6,319,160 B1
(45) Date of Patent: Nov. 20, 2001

(54) TENNIS RACKET WITH PAIRED ROLLERS

(76) Inventor: Henry Hsu, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/661,248

(22) Filed: Sep. 13, 2000

(51) Int. Cl.[7] ..... A63B 49/02
(52) U.S. Cl. ..... 473/540
(58) Field of Search ..... 473/539, 540, 473/541, 543, 524, 534, 537, 522

(56) References Cited

U.S. PATENT DOCUMENTS

| | | | | |
|---|---|---|---|---|
| 240,183 | * | 4/1881 | Richardson | 473/534 |
| 2,206,548 | * | 7/1940 | Goerke | 473/534 |
| 4,057,249 | * | 11/1977 | Reedhead et al. | 473/534 |
| 4,203,597 | * | 5/1980 | Reedhead et al. | 473/534 |
| 4,441,712 | * | 4/1984 | Guthke | 473/541 |
| 4,681,319 | * | 7/1987 | Zilinskas | 473/540 |
| 4,765,621 | * | 8/1988 | Game | 473/534 |
| 5,054,779 | * | 10/1991 | Marrello | 473/522 |

FOREIGN PATENT DOCUMENTS

| | | | | |
|---|---|---|---|---|
| 3714571 | * | 12/1988 | (DE) | 473/FOR 179 |
| 4100081 | * | 7/1992 | (DE) | 473/FOR 179 |
| 2587903 | * | 4/1987 | (FR) | 473/FOR 179 |
| 5358 | * | of 1889 | (GB) | 473/FOR 179 |
| 4305 | * | of 1914 | (GB) | 473/FOR 179 |
| 2267220 | * | 12/1993 | (GB) | 473/FOR 179 |
| 80/01757 | * | 9/1980 | (WO) | 473/FOR 179 |

* cited by examiner

*Primary Examiner*—Raleigh W. Chiu

(57) ABSTRACT

An attachment for a tennis racket is provided. The attachment has a curvature capable of engaging with a U-shaped groove of the frame of the racket, a pair of first and second lateral walls connected by two end portions without a bottom, a plurality of shafts disposed spaced apart in the attachment and connected at their two ends to the inner surfaces of the lateral walls, a plurality of rollers of saddle outer periphery rotatably engaged on the shafts on pair by pair basis and a plurality of partition posts projected transversely from the inner surface of the first lateral wall and positioned spaced apart between each pair of the rollers. A string comes in and out of the string holes in the groove and suspends from each pair of the rollers.

3 Claims, 10 Drawing Sheets

TENNIS RACKET WITH PAIRED ROLLERS

BACKGROUND OF THE INVENTION

The present invention relates to the tennis rackets and more particularly to a string attachment which dampens the striking stress and absorbs the vibration on the string surface in order to prevent a tennis elbow may be caused to the player. Besides, this string attachment is replaceable to maintain the durability of the racket.

Recently, a pretty sum of tennis rackets having damping ability of vibration have been appeared in the market, But few of them can scatter the vibrations on the string surface or has an attachment for suspending the strings which is replaceable.

FIGS. 1, 2, 3 and 4 shows a typical tennis racket 10 which includes a head 11, a groove in the outer periphery of the frame, a plurality of stringing holes 12 formed spaced apart in the groove, a plurality of aligned thru holes 13 formed spaced apart in the lateral walls of the groove positioned alternately with the stringing holes 12 for securing a plurality of shafts 14 therein and a plurality of rotors 15 rotatably secured on the shafts 14. The rotor 15 has an axial hole 151 engaged with the shaft 14 and a string groove 152 centrally formed in outer periphery for suspending from the strings 16 therein. The shafts 14 are reinforced with paintings. So that is not durable. Besides, a plurality of aligned thru holes 13 in the lateral walls of the groove may cause cracks on the frame or cause the shaft to break so that the racket becomes useless.

SUMMARY OF THE PRESENT INVENTION

The present invention has a main object to provide an attachment for a tennis racket by which the strings suspended from the rollers of saddle outer periphery can move thereabout to improve the damping ability of the string surface against the vibration on a striking of a ball.

Another object of the present invention is to provide an attachment for a tennis racket which attachment is replaceable and can be adapted as a balance weight to the frame. So that the racket may be durable and feasible.

The present invention will become more fully understood by reference to the following detailed description thereof when read in conjunction with the attached drawings.

DETAILED DESCRIPTION OF THE PREFERRED EMBODIMENT

Figure 1:
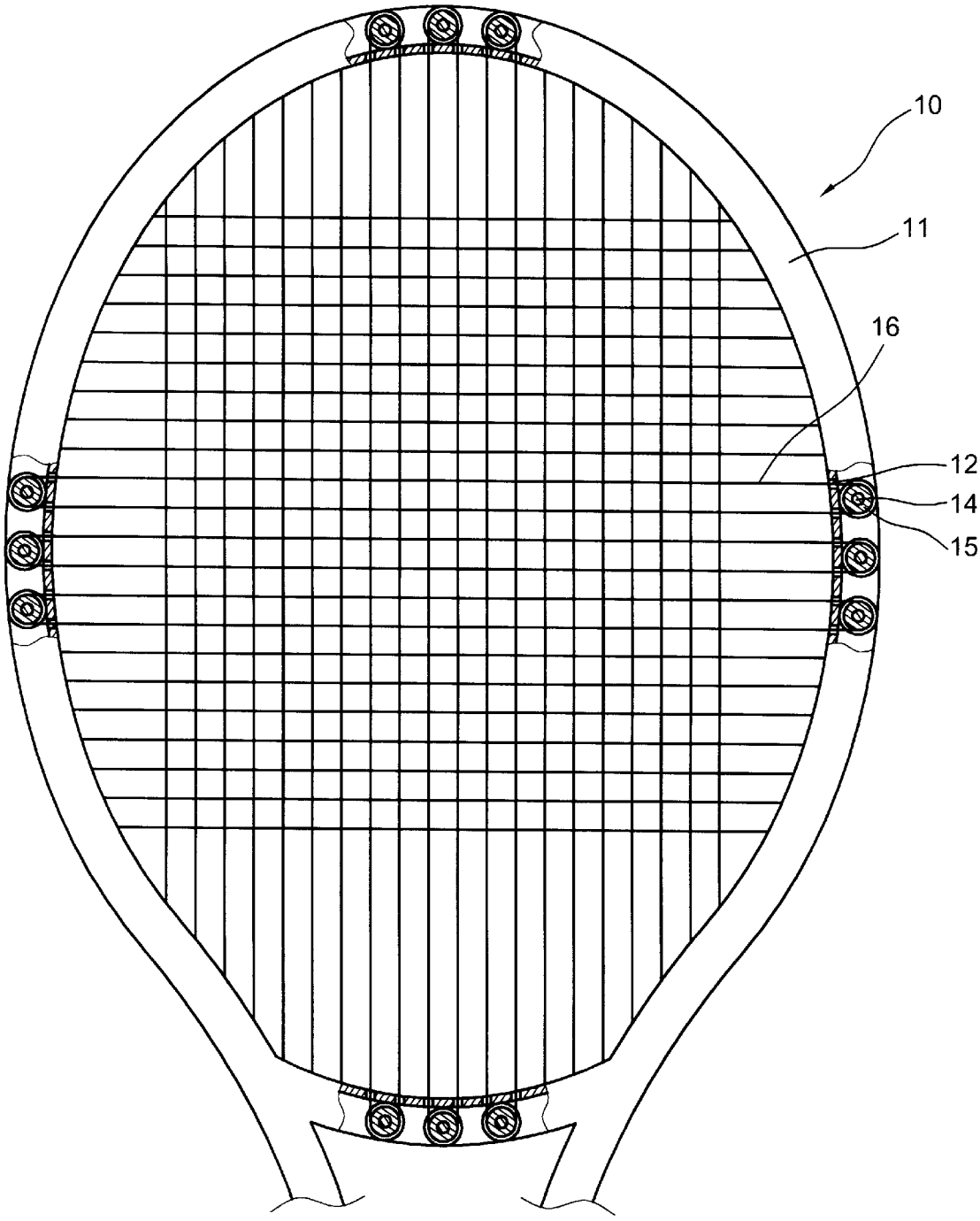
FIG. 1 Prior Art
FIGS. 1 to 4 show a tennis racket according to a prior art.
Figure 2:
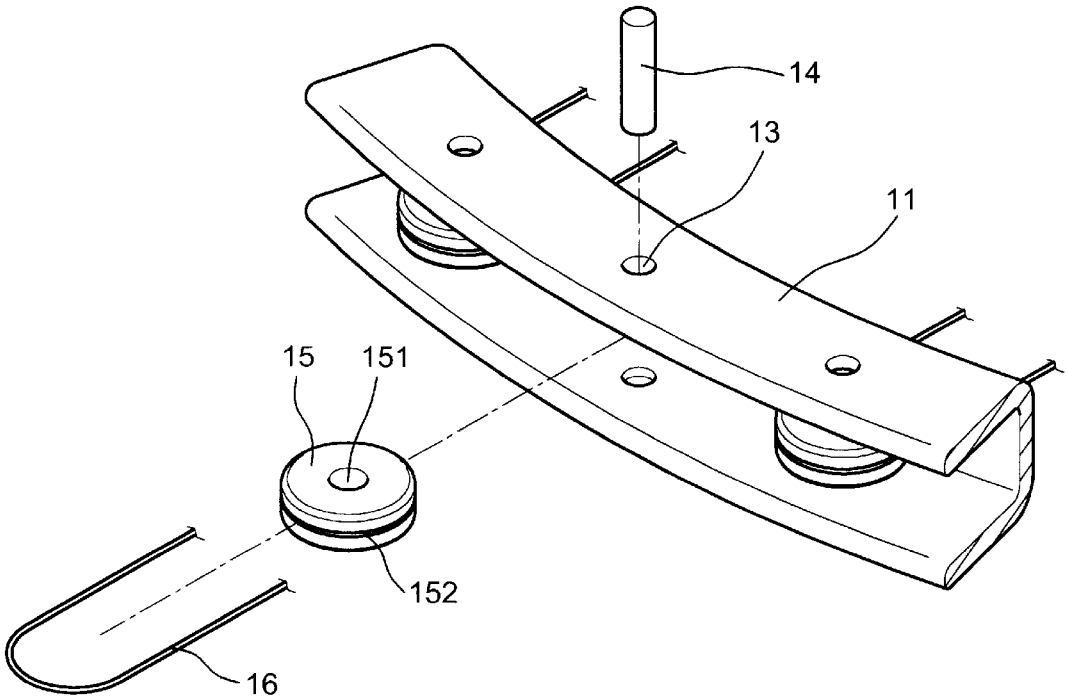
FIG.2 Prior Art
Figure 3:
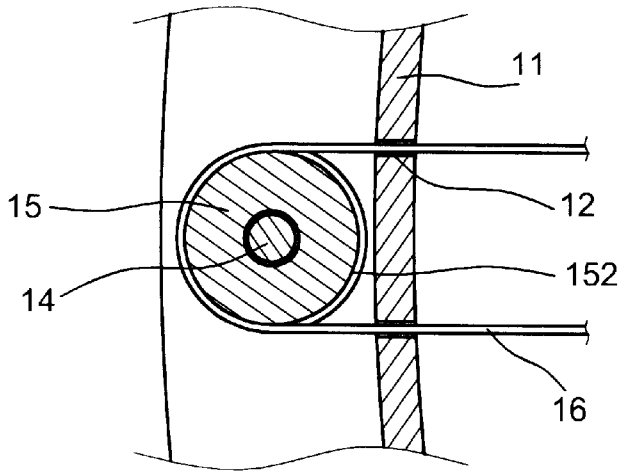
FIG.3 Prior Art
Figure 4:
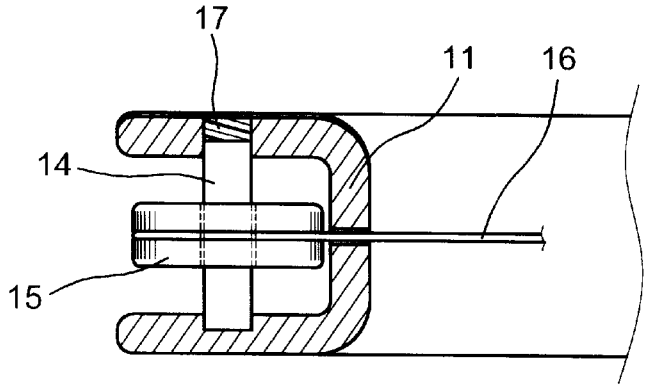
FIG.4 Prior Art
Figure 5:
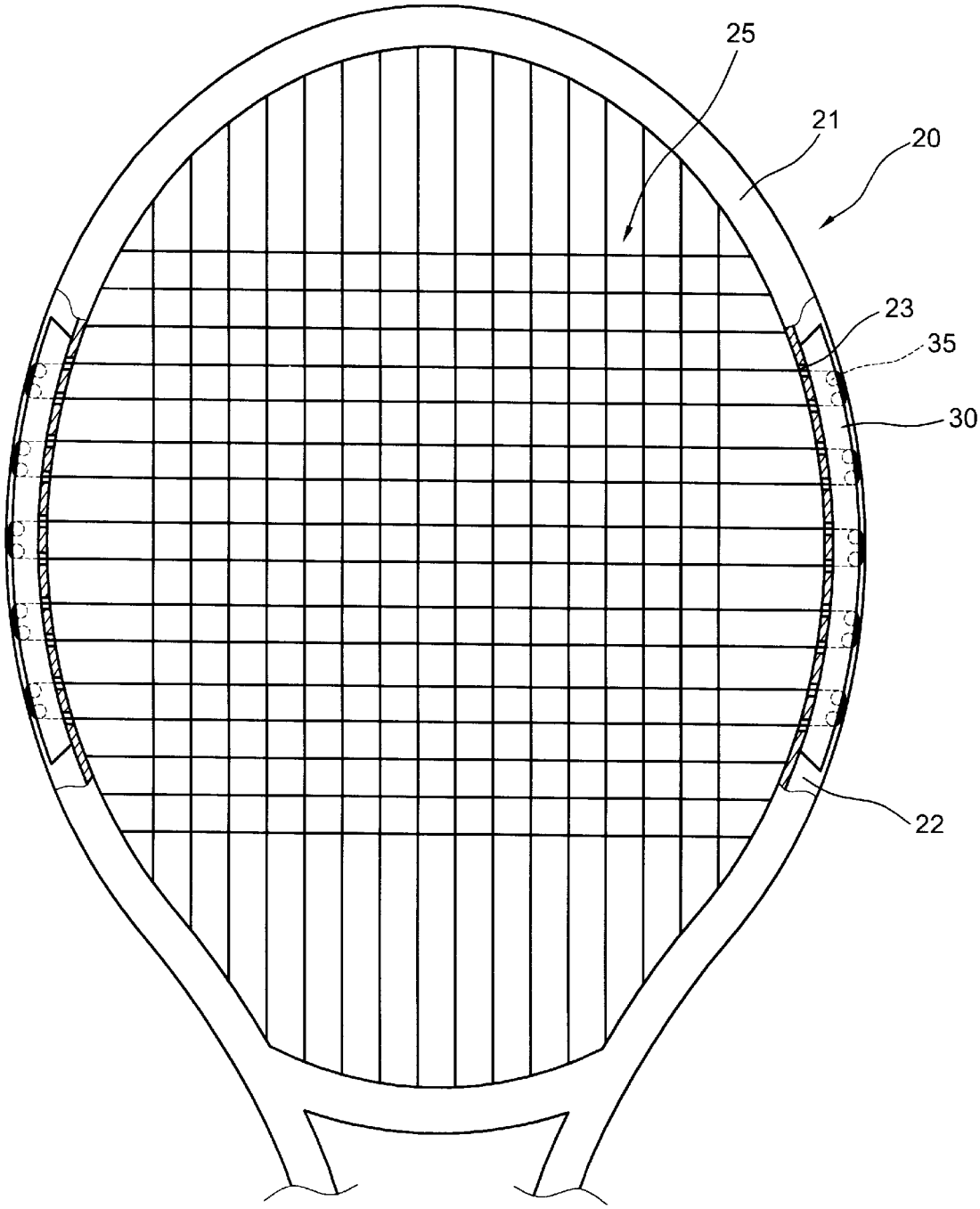
FIG. 5 is an elevational view to show a tennis racket of the preferred embodiment according to the present invention.
Figure 6:
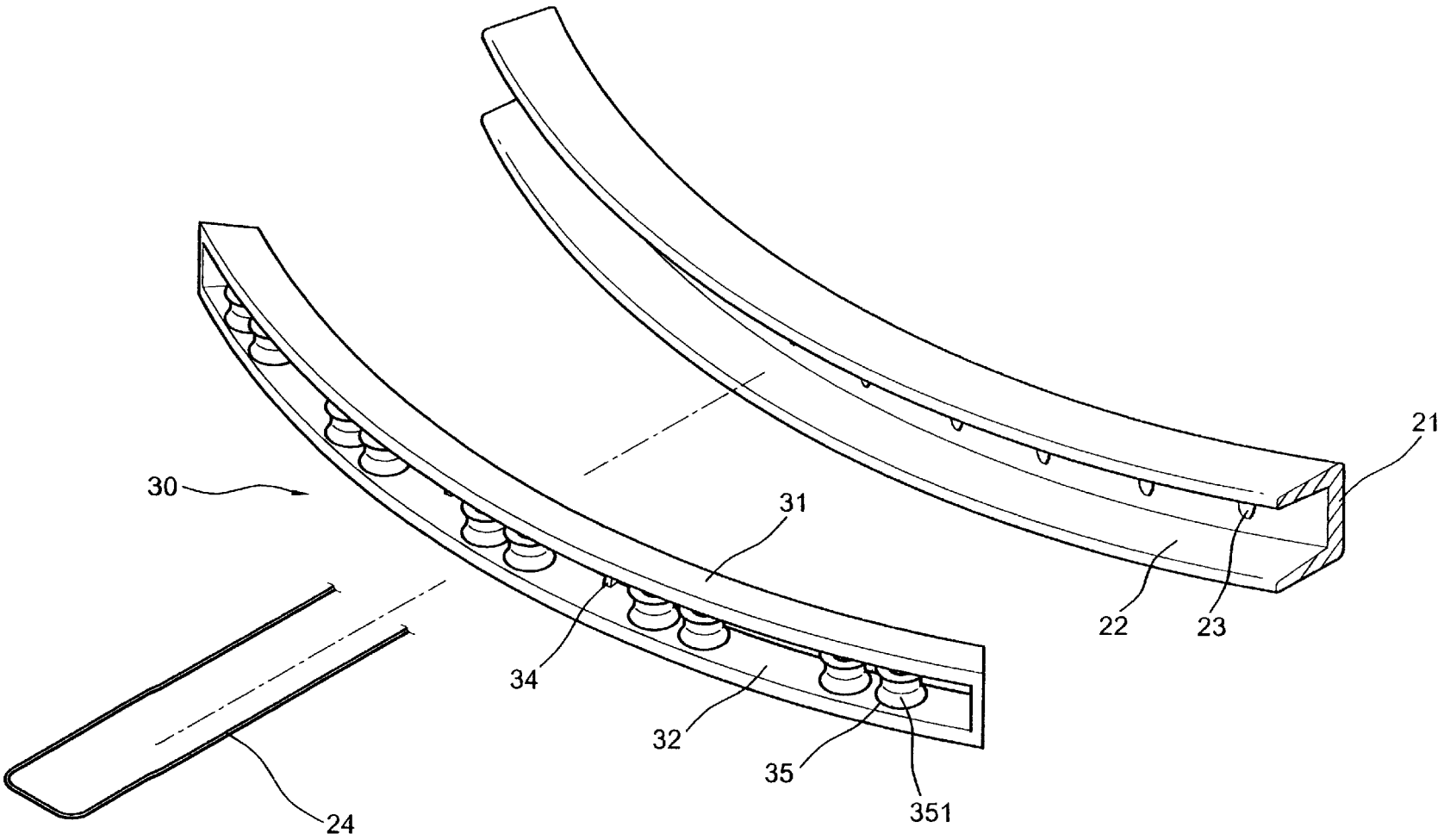
FIG. 6 is an exploded perspective view to show an attachment engageable with a frame of the racket.
Figure 7:
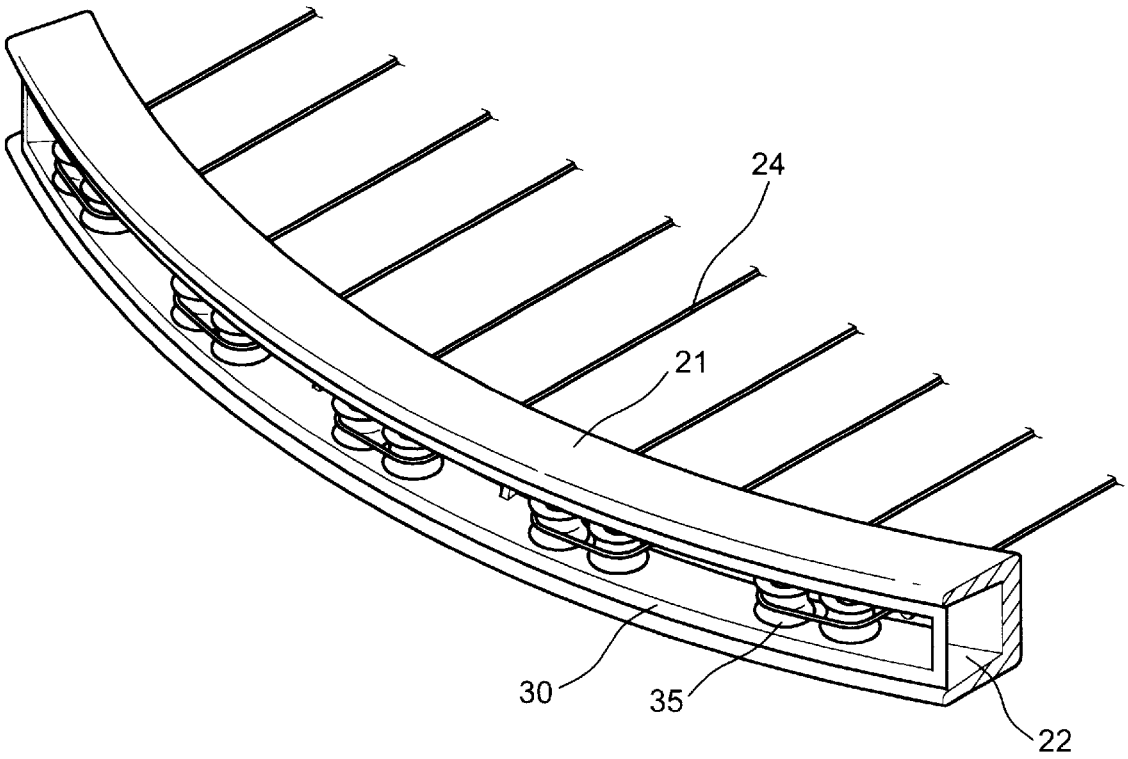
FIG. 7 is a perspective view to show an attachment in the frame suspended from a series of strings.
Figure 8:
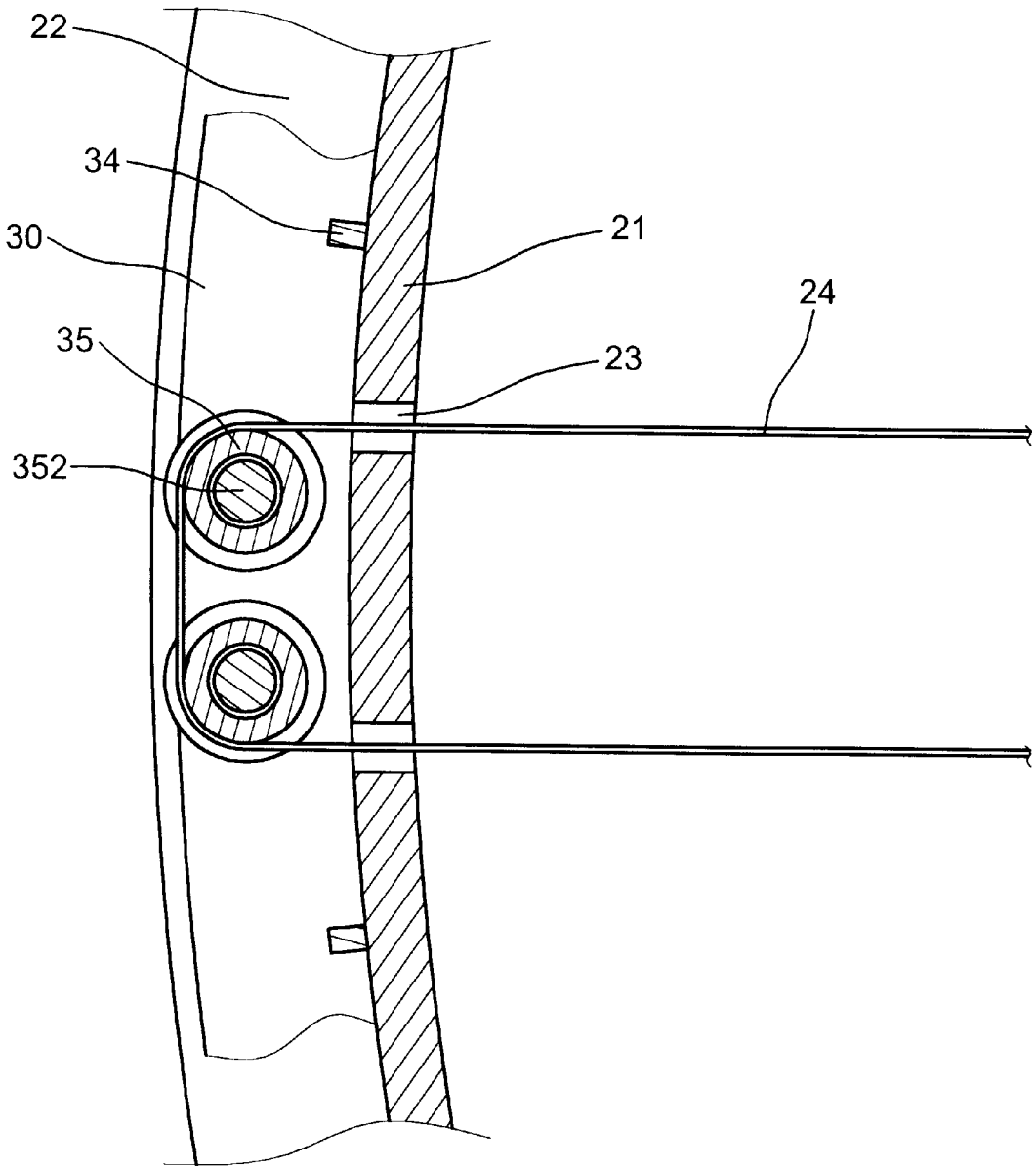
FIG. 8 is a sectional view of FIG. 7.
Figure 9:
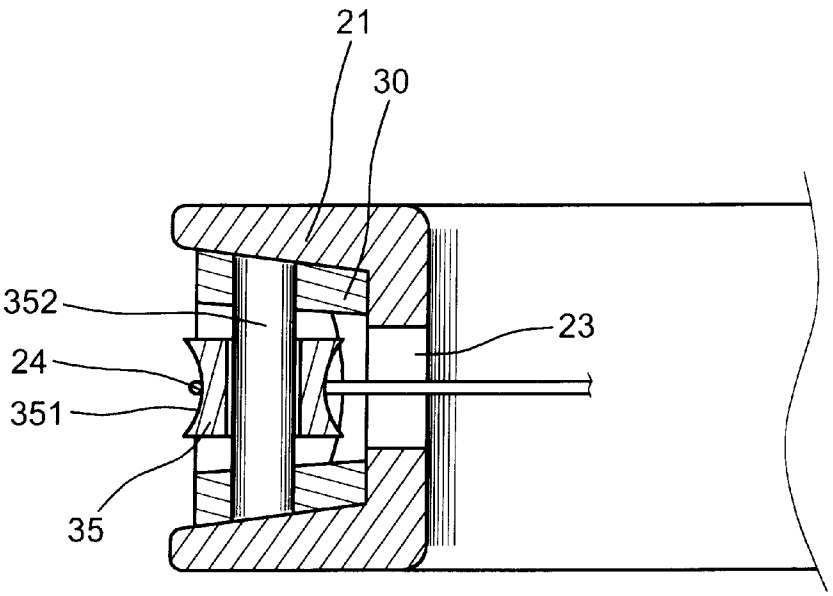
FIG. 9 is a sectional view to show a vertical position of the attachment.
Figure 10:
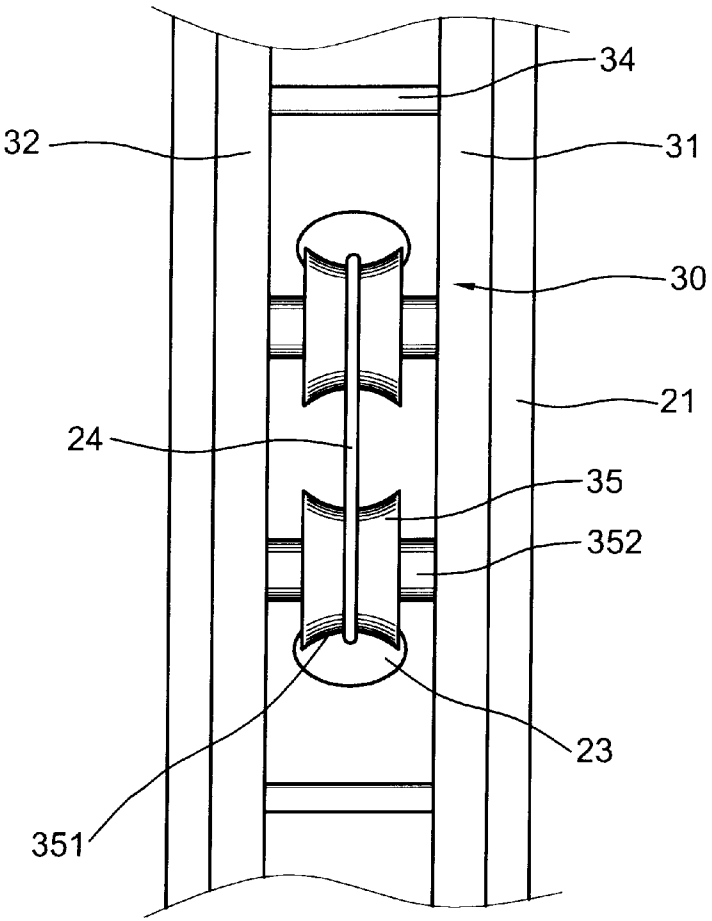
FIG. 10 is a plane and partially perspective view to show a horizontal position of the attachment.
Figure 11:
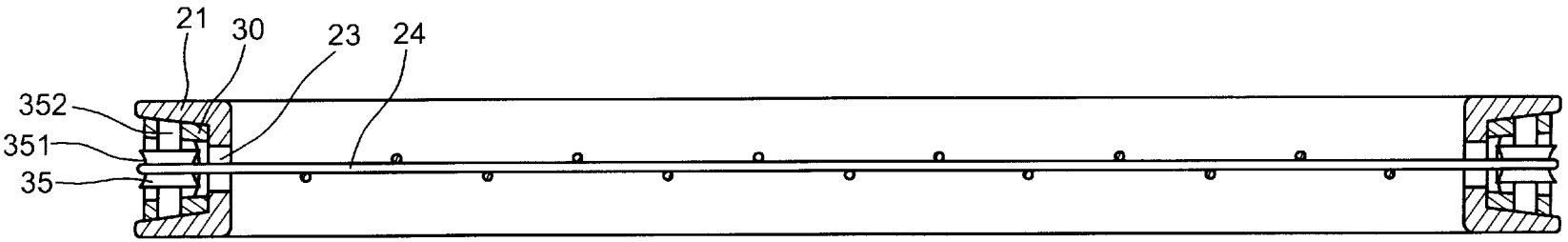
FIG. 11 is a plane view to show a racket head being unused.

With reference to FIGS. 5 to 7 of the drawings, the attachment for a tennis racket of the present invention comprises generally a racket 20 having a head and a handle (not shown). The head has an oval frame 21 of U-shaped section, a groove 22 in the outer periphery and a plurality of string holes 23 formed spaced apart in the groove 22 for stringing the strings 24 to make a string surface 25 inside the frame 21.

An attachment 30 of U-shaped section which has a curvature similar to that of the groove 22, a pair of lateral walls 31 and 32 without a bottom and connected by two end portions between which are a plurality of shafts 352 for rotatably engaging with a plurality of rollers 35. The rollers 35 each has a saddle outer periphery 351 and are positioned on pair by pair basis. Each pair of the rollers 35 suspend from a string 24 which comes in and out from the string holes 23 beside the pair of rollers 35, and plurality of partition posts 34 projected transversely from the inner surface of the lateral wall 31 positioned between each pair of the rollers 35.

When the attachments 30 are engaged within the groove 22 of the frame 21, each pair of the rollers 35 should be positioned between each pair of adjacent string holes 23. So that a string surface can be made and strings 24 may be able to suspend from each pair of the rollers 35 (as shown in FIGS. 7, 8, 9, 10 and 11).

Figure 12:
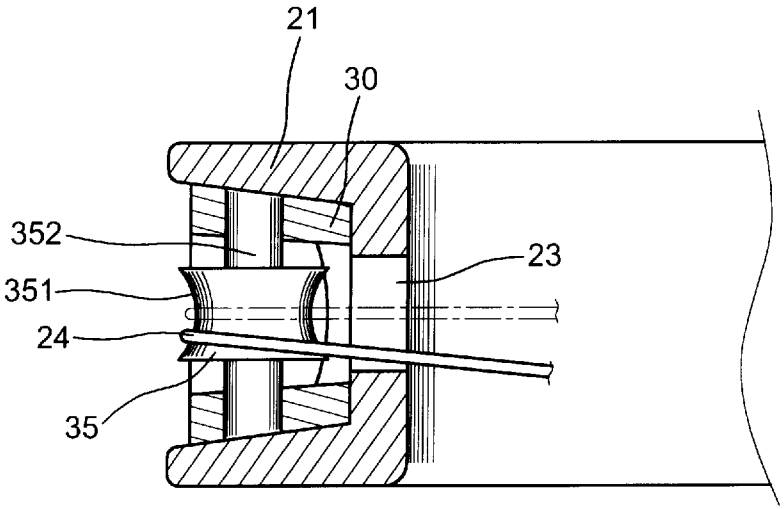
FIG. 12 is a sectional view to show the string surface of the racket under a striking.
Figure 13:
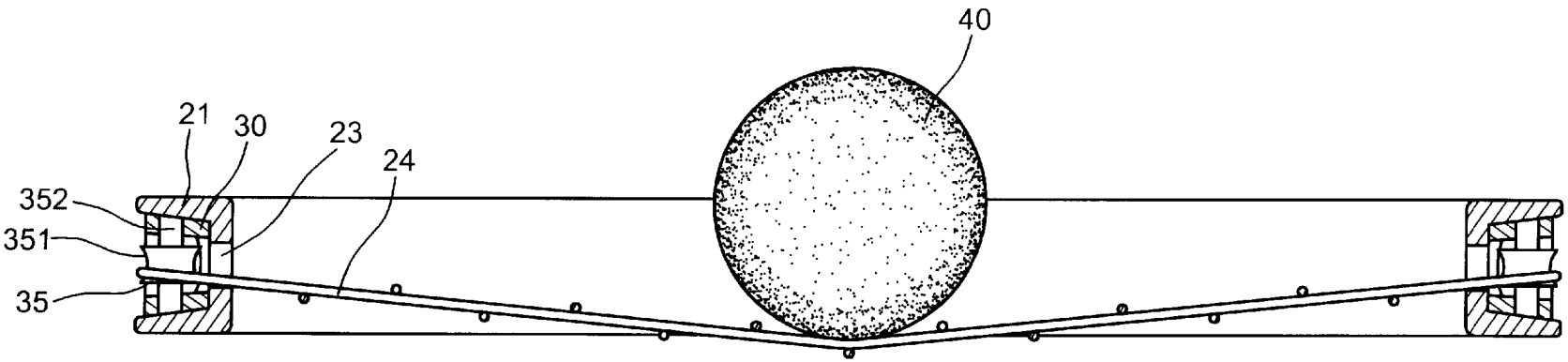
FIG. 13 shows the string surface of the racket against a tennis ball on a striking.

Referring to FIGS. 12 and 13 when the racket is unused, the string surface 25 is in a proper tension. When under a striking, the strings 24 move about the saddle outer periphery 351 of the roller 35 to dampen the vibration which a big proportion will remain in the strings 24 and the rollers 35 without transferring to the handle of the racket.

Further, the attachment 30 of the present invention is replaceable to keep the durability of the racket and can be made in different weight to balance the weight of the racket.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents,

I claim:

1. A tennis racket with paired rollers comprising:

a tennis racket comprising an oval head and a handle, said head including a frame of U-shaped section, a groove formed in outer periphery of the frame and a pluralilty of string holes formed spaced apart in a bottom of the groove;

an attachment engaged with the groove of the frame having a curvature similar to that of the groove, a pair of first and second lateral wall connected by two end portions without a bottom, a plurality of shaft spacedly disposed in the attachment and connected at their two ends to the inner surfaces of the first and second lateral walls, a plurality of rollers rotatably engaged on the shafts and positioned on pair by pair basis and a plurality of partition posts projected spaced apart from the inner wall of the first lateral wall and positioned between each pair of the rollers;

a string coming in and out of the string holes and suspended from each pair of the rollers; whereby a string surface is made inside said frame.

2. A tennis racket as recited in claim 1 wherein said roller each has a saddle outer periphery.

3. A tennis racket as recited in claim 1 wherein said attachment can be made in different weight.

* * * * *